US009763477B2

(12) United States Patent
Zhu

(10) Patent No.: US 9,763,477 B2
(45) Date of Patent: Sep. 19, 2017

(54) CERAMIC HEATING ELEMENTS FOR ELECTRONIC CIGARETTES

(71) Applicant: SHENZHEN KANGER TECHNOLOGY CO., LTD., Shenzhen, Guangdong (CN)

(72) Inventor: Xiaochun Zhu, Guangdong (CN)

(73) Assignee: SHENZHEN KANGER TECHNOLOGY CO., LTD., Shenzhen, Guangdong (CN)

( * ) Notice: Subject to any disclaimer, the term of this patent is extended or adjusted under 35 U.S.C. 154(b) by 780 days.

(21) Appl. No.: 14/362,164

(22) PCT Filed: Apr. 18, 2014

(86) PCT No.: PCT/CN2014/075691

§ 371 (c)(1),
(2) Date: Jun. 2, 2014

(87) PCT Pub. No.: WO2014/198157

PCT Pub. Date: Dec. 18, 2014

(65) Prior Publication Data

US 2015/0296887 A1 Oct. 22, 2015

Related U.S. Application Data

(63) Continuation-in-part of application No. 13/993,962, filed as application No. PCT/CN2011/072291 on Mar. 30, 2011.

(51) Int. Cl.
*A24F 47/00* (2006.01)
*H05B 3/14* (2006.01)
(Continued)

(52) U.S. Cl.
CPC ..... *A24F 47/008* (2013.01); *H05B 1/0291* (2013.01); *H05B 3/141* (2013.01); *H05B 3/42* (2013.01); *H05B 3/48* (2013.01)

(58) Field of Classification Search
CPC .... A24F 47/002; A24F 47/004; A24F 47/008; A61M 15/06
(Continued)

(56) References Cited

U.S. PATENT DOCUMENTS 8,678,012 B2 * 3/2014 Li ..... A24F 47/008 128/202.21
9,271,528 B2 * 3/2016 Liu ..... A24F 47/008
(Continued)

FOREIGN PATENT DOCUMENTS

CN 101084801 A 12/2007
CN 102106611 A 6/2011
(Continued)

OTHER PUBLICATIONS

State Intellectual Property Office of P.R. China, "International Search Report," for International Application No. PCT/CN2014/075691, dated Jul. 23, 2014, China.
State Intellectual Property Office of P.R. China, "Written Opinion," for International Application No. PCT/CN2014/075691, dated Jul. 23, 2014, China.

*Primary Examiner* — Neil Abrams
(74) *Attorney, Agent, or Firm* — Locke Lord LLP; Tim Tingkang Xia, Esq.

(57) ABSTRACT

An electronic cigarette having ceramic heating element with a heating rod has: (a) a hollow atomizing stem, (b) a first conductive ring sleeved at bottom of atomizing stem and airproof with atomizing stem, (c) a second conductive ring placed in and insulated from first conductive ring, (d) a conduit positioned in atomizing stem, with conduit base tightly contacting first conductive ring, (e) a liquid blocker positioned on top of atomizing stem, (f) a cigarette mouthpiece located on top of the atomizing stem and holds liquid blocker, and (g) a heating rod. The inner wall of atomizing stem, outer wall of conduit, top of first conductive ring, and bottom of liquid blocker together form a liquid storage
(Continued)

chamber for storing e-liquid. In one embodiment, the heating rod can be a solid ceramic heating rod. In another embodiment, the heating rod can be a hollow ceramic heating rod.

20 Claims, 6 Drawing Sheets

(51) Int. Cl.
*H05B 3/48* (2006.01)
*H05B 1/02* (2006.01)
*H05B 3/42* (2006.01)

(58) Field of Classification Search
USPC ..... 131/329
See application file for complete search history.

(56) References Cited

U.S. PATENT DOCUMENTS

| | | | | |
|---|---|---|---|---|
| 9,289,014 | B2 * | 3/2016 | Tucker | A24F 47/008 |
| 9,578,898 | B2 * | 2/2017 | Liu | A24F 47/008 |
| 9,622,511 | B2 * | 4/2017 | Zhu | A24F 47/008 |
| 2009/0095312 | A1 | 4/2009 | Herbrich et al. | |
| 2013/0263869 | A1 * | 10/2013 | Zhu | A24F 47/002 131/329 |
| 2015/0296887 | A1 * | 10/2015 | Zhu | A24F 47/008 131/329 |

FOREIGN PATENT DOCUMENTS

| | | | |
|---|---|---|---|
| CN | 201986689 | U | 9/2011 |
| CN | 102894485 | A | 1/2013 |
| WO | 2012129787 | A1 | 10/2012 |

* cited by examiner

CERAMIC HEATING ELEMENTS FOR ELECTRONIC CIGARETTES

CROSS-REFERENCE TO RELATED APPLICATIONS

This application is a continuation in part of a U.S. patent application Ser. No. 13/993,962 filed on Jun. 13, 2013, entitled 'Electronic Cigarette', by Xiaochun ZHU, which itself is a U.S. National Phase Application of Application No. PCT/CN2011/072291 , filed with the Chinese Patent Office on Mar. 30, 2011, entitled 'Electronic Cigarette', by Xiaochun ZHU, which itself claims priority of Chinese Patent Application No. 201110075226.4, filed with the Chinese Patent Office on Mar. 28, 2011, entitled 'Electronic Cigarette', by Xiaochun ZHU, the disclosures of which are incorporated herein in their entireties by reference.

Some references, if any, which may include patents, patent applications and various publications, may be cited and discussed in the description of this invention. The citation and/or discussion of such references, if any, is provided merely to clarify the description of the present invention and is not an admission that any such reference is 'prior art' to the invention described herein. All references listed, cited and/or discussed in this specification are incorporated herein by reference in their entireties and to the same extent as if each reference was individually incorporated by reference.

FIELD

The present invention mainly relates to the field of electronic cigarette (or e-cigarette), and more particularly to several ceramic heating elements for electronic cigarettes.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

It is well known that smoking cigarette is harmful to smoker's health. The active ingredient in a cigarette is mainly nicotine. During smoking, nicotine, along with tar aerosol droplets produced in the cigarette burning, are breathed into the alveolus and absorbed quickly by the smoker. Once nicotine is absorbed into the blood of the smoker, nicotine then produces its effect on the receptors of the smoker's central nervous system, causing the smoker relax and enjoy an inebriety similar to that produced by an exhilarant.

Nicotine is a potentparasympathomimeticalkaloid with low molecular weight and short half-life in blood. In small doses, nicotine acts as a stimulant. This stimulant effect causes many smokers to form dependency on tobacco smoking. However, the major harmful ingredient of tobacco is not the nicotine, but tar. Tar is the common name for the resinous, partially combusted particulate matter produced by the burning of tobacco in the act of smoking. Tar is toxic and damages the smoker's lungs over time through various biochemical and mechanical processes. Tar also damages the mouth by rotting and blackening teeth, damaging gums, and desensitizing taste buds.

It is therefore desirable to have an electronic cigarette (or e-cigarette) that delivers the nicotine without toxic tar. The electronic cigarette is sometimes referred as electronic vaporing device, personal vaporizer (PV), or electronic nicotine delivery system (ENDS). It is a battery-powered device which simulates tobacco smoking. It generally uses a heating element that vaporizes a liquid solution. Some solutions contain a mixture of nicotine and flavorings, while others release a flavored vapor without nicotine. Many are designed to simulate smoking implements, such as cigarettes or cigars, in their use and/or appearance, while others are considerably different in appearance.

Conventionally, the liquid solution in the electronic cigarette is stored in a liquid supplying reservoir. The liquid supplying reservoir contains various types of fibers such as cotton, polypropylene fiber, terylene fiber, or nylon filer. The liquid solution is soaked in these fibers and the liquid solution is passed through these fibers to a heating element to be vaporized. The liquid solution is vaporized on the heating element with fibers. However, the poor contact of the fibers with heating element causes uneven vaporization. Additionally the direct contact of the fiber with heating element also causes a burning smell. It is desirable to allow liquid solution to make direct contact with the heating element without any fibers such that the liquid solution is vaporized evenly without the burning smell.

The e-liquid usually contains three basic elements: nicotine, flavor concentrate, and diluents. The flavor concentrate provides the electronic cigarettes various flavors to meet the smokers' desires. With traditional fiber based e-liquid storage, once one flavor concentrate is used, it is very difficult to remove the residue of the flavor concentrate used. For example, if an orange flavored concentrate is used in an electronic cigarette, one has to remove the fibers in the storage to completely removed residue of the orange flavored concentrate, to clean the e-liquid storage, to replace the fiber in the storage and to add a new flavor concentrate to switch to the new flavor concentrate. It is desirable to have a e-liquid storage without fiber inside, and once the e-liquid is used up, the e-liquid is completed evaporated without any residue of the previous flavor concentrate.

Therefore, heretofore unaddressed needs exist in the art to address the aforementioned deficiencies and inadequacies.

SUMMARY

In one aspect, the present invention relates to an electronic cigarette having ceramic heating element with a solid heating rod. The electronic cigarette has: (a) a hollow atomizing stem, (b) a first conductive ring, (c) a second conductive ring, (d) a conduit, (e) a liquid blocker, (f) a cigarette mouthpiece, and (g) a solid heating rod. In certain embodiments, the first conductive ring is sleeved at the bottom of the atomizing stem and airproof with the atomizing stem. The second conductive ring placed in the first conductive ring and insulated from the first conductive ring. The conduit is positioned in the atomizing stem, with the base of the conduit contacting the first conductive ring tightly. The liquid blocker is positioned on the top of the atomizing stem. The cigarette mouthpiece is located on the top of the atomizing stem and holds the liquid blocker. The inner wall of the atomizing stem, the outer wall of the conduit, the top of the first conductive ring, and the bottom of the liquid blocker together form a liquid storage chamber for storing e-liquid. The solid heating rod with two end portions of the solid heating rod is positioned in the liquid storage chamber.

The middle portion passes transversally through the conduit and is held inside the conduit.

In certain embodiments, the electronic cigarette further includes: (h) a battery positioned in a battery compartment at the bottom of the first conductive ring, (i) a mounting hole at the top of the first conductive ring, and (j) an insulation ring is arranged between the first conductive ring and the second conductive ring. The mounting hole is in communication with the battery compartment, the second conductive ring is arranged inside the mounting hole.

In one embodiment, the solid heating rod has one or more heating wires arranged on the surface of the solid heating rod. In another embodiment, the solid heating rod has one or more heating wires arranged inside the body of the solid heating rod. The one or more heating wires are used to atomize the e-liquid surrounding the solid heating rod. In certain embodiments, the heating wires can be made of: nickel chromium alloy, platinum wire; and iron chromium aluminum alloy wire with real earth element.

In one embodiment, the solid heating rod has a number of through holes in single line to wind one heating wire. In another embodiment, the solid heating rod has a number of through holes in two lines to wind two heating wires. In one embodiment, the two heating wires are electronically connected in parallel. In another embodiment, the two heating wires are electronically connected in serial. In certain embodiments, the two ends of the battery are electrically connected to the first conductive ring and the second conductive ring, respectively. The two ends of the heating wire are electrically connected to the first conductive ring and the second conductive ring, respectively.

In another aspect, the present invention relates to an electronic cigarette having ceramic heating element with a hollow heating rod. The electronic cigarette has: (a) a hollow atomizing stem, (b) a first conductive ring, (c) a second conductive ring, (d) a conduit, (e) a liquid blocker, (f) a cigarette mouthpiece, and (g) a hollow heating rod. In certain embodiments, the first conductive ring is sleeved at the bottom of the atomizing stem and airproof with the atomizing stem. The second conductive ring placed in the first conductive ring and insulated from the first conductive ring. The conduit is positioned in the atomizing stem, with the base of the conduit contacting the first conductive ring tightly. The liquid blocker is positioned on the top of the atomizing stem. The cigarette mouthpiece is located on the top of the atomizing stem and holds the liquid blocker. The inner wall of the atomizing stem, the outer wall of the conduit, the top of the first conductive ring, and the bottom of the liquid blocker together form a liquid storage chamber for storing e-liquid. The hollow heating rod with two end portions of the hollow heating rod is positioned in the liquid storage chamber. The middle portion passes transversally through the conduit and is held inside the conduit.

In certain embodiments, the electronic cigarette further includes: (h) a battery positioned in a battery compartment at the bottom of the first conductive ring, (i) a mounting hole at the top of the first conductive ring, and (j) an insulation ring is arranged between the first conductive ring and the second conductive ring. The mounting hole is in communication with the battery compartment, the second conductive ring is arranged inside the mounting hole.

In one embodiment, the hollow heating rod has one or more heating wires arranged on the surface of the hollow heating rod. In another embodiment, the hollow heating rod has one or more heating wires arranged inside the body of the hollow heating rod. The one or more heating wires are used to atomize the e-liquid surrounding the hollow heating rod. In certain embodiments, the heating wires can be made of: nickel chromium alloy, platinum wire; and iron chromium aluminum alloy wire with real earth element.

In one embodiment, the hollow heating rod has a number of through holes in single line to wind one heating wire. In another embodiment, the hollow heating rod has a number of through holes in two lines to wind two heating wires. In one embodiment, the two heating wires are electronically connected in parallel. In another embodiment, the two heating wires are electronically connected in serial. In certain embodiments, the two ends of the battery are electrically connected to the first conductive ring and the second conductive ring, respectively. The two ends of the heating wire are electrically connected to the first conductive ring and the second conductive ring, respectively.

These and other aspects of the present invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment. The drawings do not limit the present invention to the specific embodiments disclosed and described herein. The drawings are not necessarily to scale, emphasis instead being placed upon clearly illustrating the principles of the invention, and wherein.

DETAILED DESCRIPTION

Figure 1:
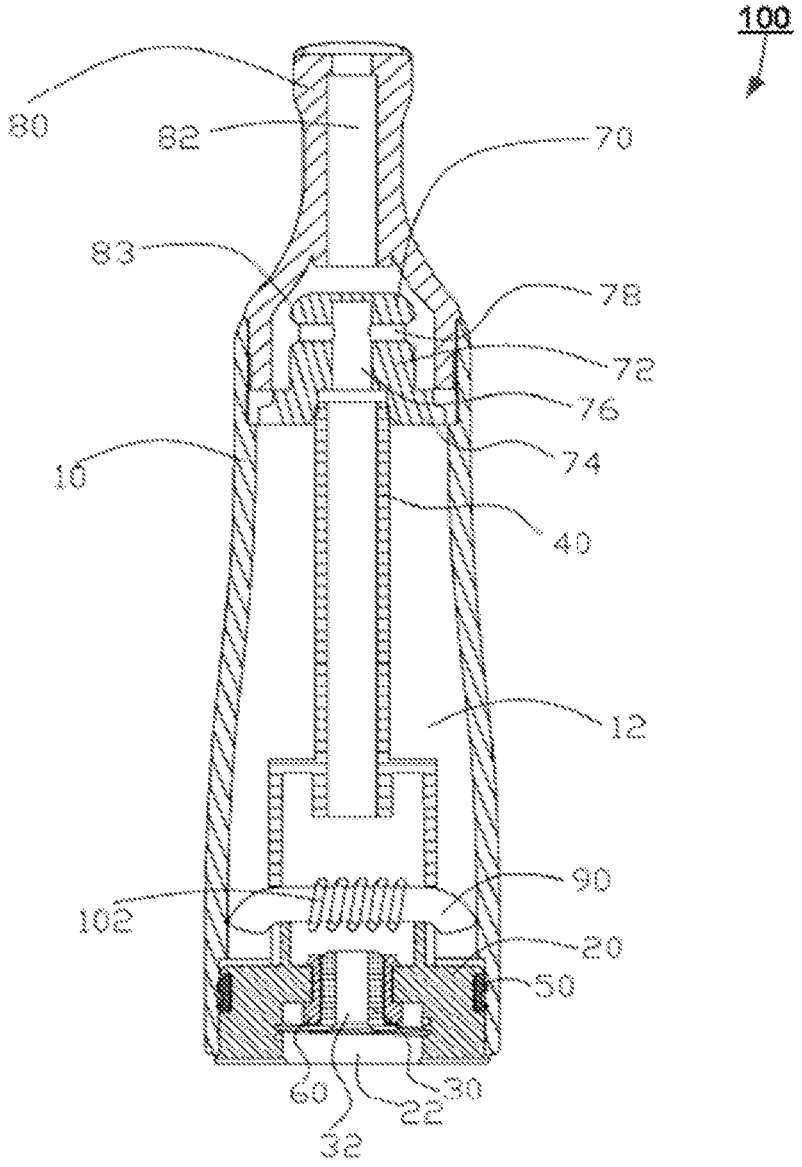
FIG. 1 is a schematic diagram of an overall structure of an electronic cigarette according to one embodiment of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being 'on' another element, it can be directly on the other element or intervening elements may be present therebetween. In contrast, when an element is referred to as being 'directly on' another element, there are no intervening elements present. As used herein, the term 'and/or' includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms 'a', 'an' and 'the' are intended to include the plural forms as well, unless the context clearly indicates otherwise. It will be further understood that the terms 'comprises' and/or 'comprising,' or 'includes' and/or 'including' or 'has' and/or 'having' when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as 'lower' or 'bottom', 'upper' or 'top,' and 'front' or 'back' may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the 'lower' side of other elements would then be oriented on 'upper' sides of the other elements. The exemplary term 'lower', can therefore, encompasses both an orientation of 'lower' and 'upper,' depending of the particular orientation of the figure. Similarly, if the device in one of the figures is turned over, elements described as 'below' or 'beneath' other elements would then be oriented 'above' the other elements. The exemplary terms 'below' or 'beneath' can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, 'around', 'about' or 'approximately' shall generally mean within 20 percent, preferably within 10 percent, and more preferably within 5 percent of a given value or range. Numerical quantities given herein are approximate, meaning that the term 'around', 'about' or 'approximately' can be inferred if not expressly stated.

The description will be made as to the embodiments of the present invention in conjunction with the accompanying drawings FIGS. 1 through 6. In accordance with the purposes of this invention, as embodied and broadly described herein, this invention, in one aspect, relates to a ceramic heating element for an electronic cigarette.

Many specific details are provided in the following descriptions to make the present invention be fully understood, but the present invention may also be implemented by using other manners different from those described herein, so that the present invention is not limited by the specific embodiments disclosed in the following.

FIG. 1 is a schematic diagram of an overall structure of an electronic cigarette 100 according to one embodiment of the present invention. The electronic cigarette 100 includes: a cylindrical hollow atomizing stem 10, a first conductive ring 20 sleeved at the bottom of the atomizing stem 10 and airproof with the atomizing stem 10 by using a leakproof rubber ring 50, a second conductive ring 30 arranged in the first conductive ring 20 and insulated from the first conductive ring 20 by an insulation ring 60, a conduit 40 held in the atomizing stem 10, with base contacting the first conductive ring 20 tightly, a liquid blocker 70 arranged on the top of the atomizing stem 10, and a cigarette mouthpiece 80 arranged on the top of the atomizing stem 10 simultaneously and holding the liquid blocker 70.

One distinctive feature of the electronic cigarette according to the present invention is that, the inner wall of the atomizing stem 10, the outer wall of the conduit 40, the top of the first conductive ring 20, and the bottom of the liquid blocker 70 together form a liquid storage chamber 12 for storing e-liquid. The liquid storage chamber 12, because of its good seal from other components of the electronic cigarette 100, can store e-liquid without cigarette fiber, so the structure of the electronic cigarette 100 is greatly simplified as compared with a conventional electronic cigarette.

Another distinctive feature of the electronic cigarette according to the present invention is that, the electronic cigarette 100 further includes a fiber rope 90, wherein two end portions of the fiber rope 90 are placed within the liquid storage chamber 12, and a middle portion thereof passes transversally through the conduit 40 and is held inside the conduit 40. In addition, a portion of the fiber rope 90 that is held within the conduit 40 (i.e., the middle portion) is wrapped with a heating wire 102. When e-liquid is injected into the liquid storage chamber 12, the e-liquid is automatically immersed into the fiber rope 90. In certain embodiments, the heating wire 102 can be made of platinum wire, nickel chromium alloy, or iron chromium aluminum alloy wire with real earth element. When the heating wire 102 is energized, the heating wire 102 atomizes the e-liquid immersed in the fiber rope 90. This atomizing method has a high atomizing speed and generates more smoke as compared with a conventional electronic cigarette.

In certain embodiments, the first conductive ring 20 is positioned at the bottom with a battery compartment 22, and at the top with a mounting hole (not identified) in communication with the battery compartment 22. The second conductive ring 30 is mounted within the mounting hole, and the second conductive ring 30 is longitudinally provided with a flow-guiding hole 32. Furthermore, the insulation ring 60 is arranged between the first conductive ring 20 and the second conductive ring 30.

The two ends of the heating wire 102 are electrically connected to the first conductive ring 20 and the second conductive ring 30, respectively. When a battery is mounted in the battery compartment 22, positive and negative poles of the battery is respectively connected to the first and second conductive rings 20 and 30, so that the heating wire 102 is energized and thus provides heat, thereby quickly atomizing e-liquid in the fiber rope 90.

In certain embodiments, the liquid blocker 70 includes a body portion 72 and a flange 74 formed at the bottom of the body portion 72. The flange 74 seals the liquid storage chamber 12, and prevents e-liquid in the liquid storage chamber 12 from flowing backwards. The body portion 72 of the liquid blocker 70 is provided with a longitudinal hole 76 in communication with an interior of the conduit 40 and a transverse hole 78 in communication with the longitudinal hole 76. In addition, a gap 83 is formed between two side edges at the top of the body portion 72 and the inner wall of the cigarette mouthpiece 80.

In certain embodiments, an air flow hole 82 in communication with the transverse hole 78 is formed inside the cigarette mouthpiece 80.

In certain embodiments, the heating wire 102 is heated up to produce a high temperature to atomize e-liquid in or around the fiber rope 90. When a user sucks the electronic cigarette 100 from the cigarette mouthpiece 80, air outside the battery compartment 22 flows through the flow-guiding hole 32 into the conduit 40, and when flowing upwards, the external air carries smoke generated by atomizing the e-liquid to flow. The mixed air flow goes through the conduit 40, and then flows into the air flow hole 82 inside the cigarette mouthpiece 80 through the longitudinal hole 76, the transverse hole 78, and the gap 83, and is finally inhaled by the user.

In the embodiments described above, the fiber rope 90 has direct contact with the heating wire 102. When the heating wire 102 is heated up to a high temperature, it may cause the atomized e-liquid to be mixed with the smell of burnt fiber rope 90. On the other hand, the fiber rope 90 is not rigid, and the contact between the heating wire 102 and the fiber rope 90 may not be consistent. This may cause the atomization process to be uneven, or incomplete.

One solution to above problems is to replace the fiber rope 90 with a ceramic heating rod. The ceramic heating rod has a rigid surface and the heating wire 102 can make good contact to the ceramic heating rod. Since the heating rod is made of ceramic, it holds the heat well and evenly once the ceramic heating rod is heated up to a high temperature. Therefore, the ceramic heating rod makes the heating evenly, consistently, and achieve better results, without any burning smell.

Figure 2A:
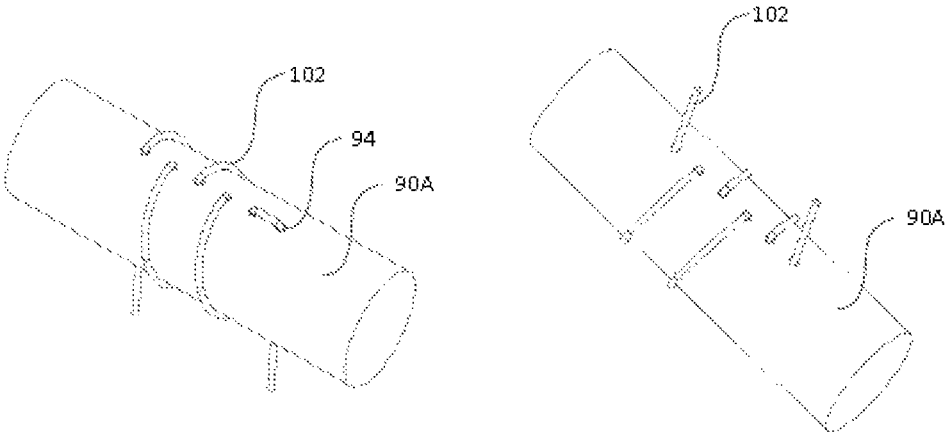
FIG. 2A shows two perspective views of a heating element with a solid ceramic rod according to one embodiment of the present invention.
Figure 2B:
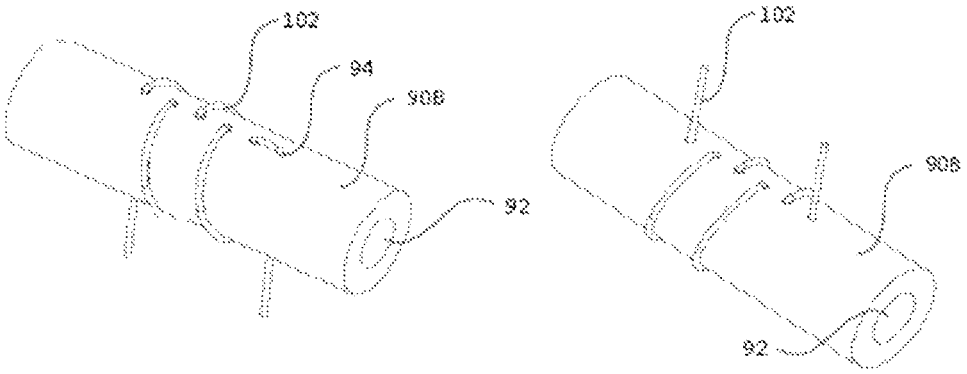
FIG. 2B shows two perspective views of a heating element with a hollow ceramic rod for e-liquid passage according to another embodiment of the present invention.

Referring now to FIGS. 2A and 2B, two perspective views of a heating element with a solid ceramic rod is shown in FIG. 2A and two perspective views of a hollow heating element for liquid solution passage are shown in FIG. 2B. In one embodiment, the heating element includes: (a) a solid heating rod 90A, (b) a heating wire 102, and (c) six through holes 94 from one side of the solid heating rod 90A to the opposite side of the solid heating rod 90A with substantially equal distance between these through holes 94. In another embodiment, the heating element includes: (a) a hollow heating rod 90B having a through hole 92 in the center of the hollow heating rod 90B, (b) a heating wire 102, and (c) six through holes 94 from one side of the hollow heating rod 90B to the opposite side of the hollow heating rod 90B with substantially equal distance between these through holes 94. The heating wire 102 is wound in the following manner:

(a) thread the first end of the heating wire 102 through the first through hole 94;

(h) Wind the second end of the heating wire 102 clockwise for half circle;

(c) thread the second end of the heating wire 102 through the second through hole 94;

(d) wind the second end of the heating wire 102 clockwise for half circle;

(e) thread the second end of the heating wire 102 through the third through hole 94;

(f) Wind the second end of the heating wire 102 clockwise for half circle;

(g) thread the second end of the heating wire 102 through the fourth through hole 94;

(h) wind the second end of the heating wire 102 clockwise for half circle;

(i) thread the second end of the heating wire 102 through the fifth through hole 94; and (j) thread the second end of the heating wire 102 through the sixth through hole 94.

Figure 3A:
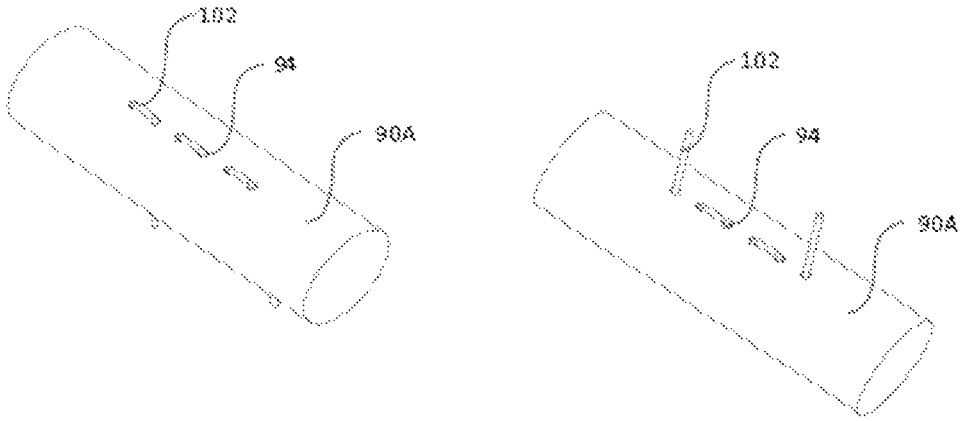
FIG. 3A shows two perspective views of a heating element with a solid ceramic rod according to one embodiment of the present invention.
Figure 3B:
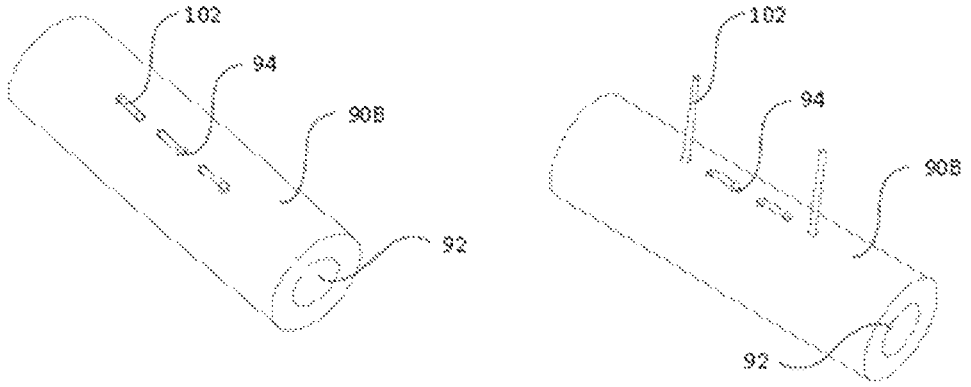
FIG. 3B shows two perspective views of a heating element with a hollow ceramic rod for e-liquid passage according to another embodiment of the present invention.

Referring now to FIGS. 3A and 3B, two perspective views of a heating element with a solid ceramic rod is shown in FIG. 3A and two perspective views of a hollow heating element for liquid solution passage are shown in FIG. 3B. In one embodiment, the heating element includes: (a) a solid heating rod 90A, (b) a heating wire 102, and (c) six through holes 94 from one side of the solid heating rod 90A to the opposite side of the solid heating rod 90A with substantially equal distance between these through holes 94. In another embodiment, the heating element includes: (a) a hollow heating rod 90B having a through hole 92 in the center of the hollow heating rod, (b) a heating wire 102, and (c) six through holes 94 from one side of the hollow heating rod 90B to the opposite side of the hollow heating rod 90B with substantially equal distance between these through holes 94. The heating wire 102 is wound in the following manner:

(a) thread the first end of the heating wire 102 through the first through hole 94;

(b) bend the second end of the heating wire 102 towards the second through hole 94;

(c) thread the second end of the heating wire 102 through the second through hole 94;

(d) bend the second end of the heating wire 102 towards the third through hole 94;

(e) thread the second end of the heating wire 102 through the third through hole 94;

(f) bend the second end of the heating wire 102 towards the fourth through hole 94;

(g) thread the second end of the heating wire 102 through the fourth through hole 94;

(h) bend the second end of the heating wire 102 towards the fifth through hole 94;

(i) thread the second end of the heating wire 102 through the fifth through hole 94;

(j) bend the second end of the heating wire 102 towards the sixth through hole 94; and (k) thread the second end of the heating wire 102 through the sixth through hole 94.

Figure 4A:
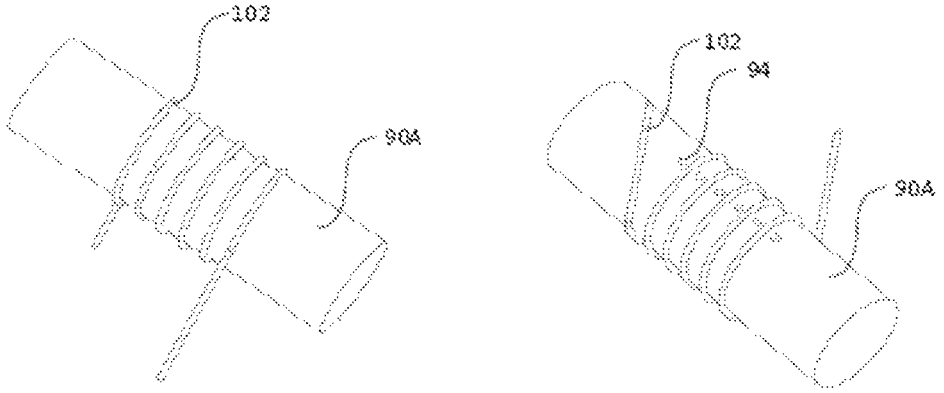
FIG. 4A shows two perspective views of a heating element with a solid ceramic rod according to one embodiment of the present invention.
Figure 4B:
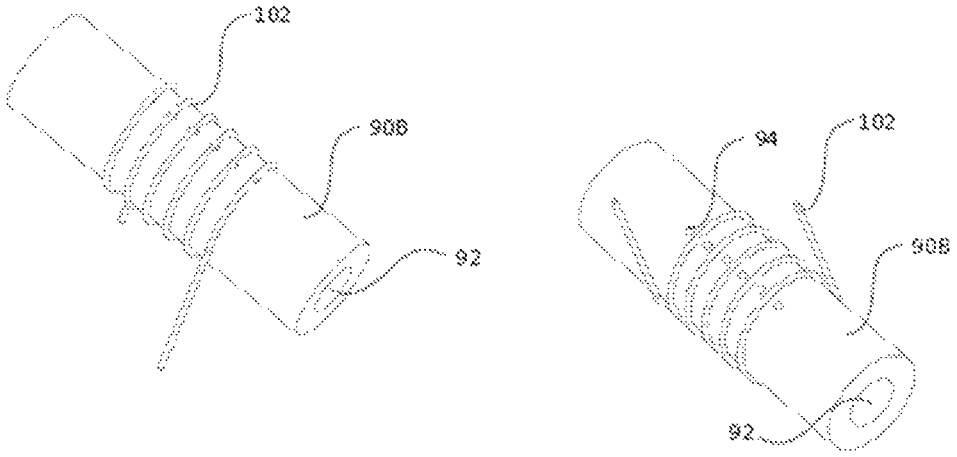
FIG. 4B shows two perspective views of a heating element with a hollow ceramic rod for e-liquid passage according to another embodiment of the present invention.

Referring now to FIGS. 4A and 4B, two perspective views of a heating element with a solid ceramic rod is shown in FIG. 4A and two perspective views of a hollow heating element for liquid solution passage are shown in FIG. 4B. In one embodiment, the heating element includes: (a) a solid heating rod 90A, (h) a heating wire 102, and (c) six through holes 94 from one side of the solid heating rod 90A to the opposite side of the solid heating rod 90A with substantially equal distance between these through holes 94. In another embodiment, the heating element includes: (a) a hollow heating rod 90B having a through hole 92 in the center of the hollow heating rod, (b) a heating wire 102, and (c) six through holes 94 from one side of the hollow heating rod 90B to the opposite side of the hollow heating rod 90B with substantially equal distance between these through holes 94. In these embodiments, the through holes 94 are not used. The heating wire 102 is wound in the following manner:

(a) hold the first end of the heating wire 102 through the first through hole 94; and (b) wind the second end of the heating wire 102 five times in clockwise direction with substantially equal distance among the circles of the heating wire 102.

Figure 5A:
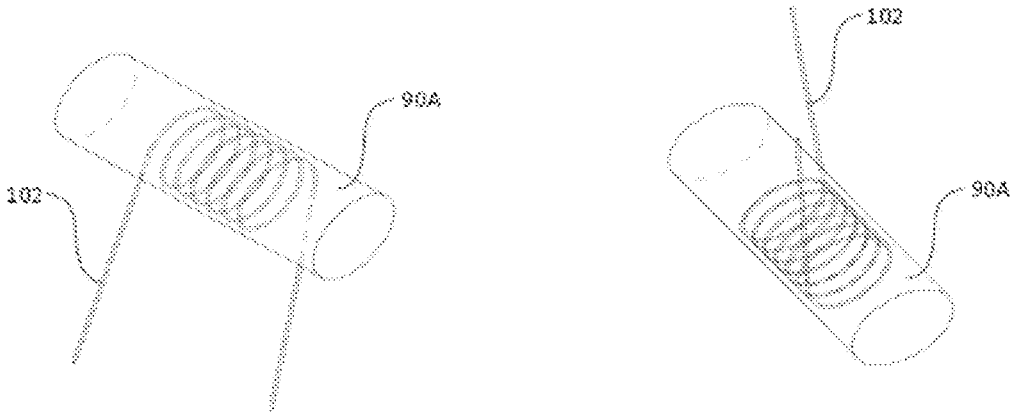
FIG. 5A shows two perspective views of a heating element with a solid ceramic rod according to one embodiment of the present invention.
Figure 5B:
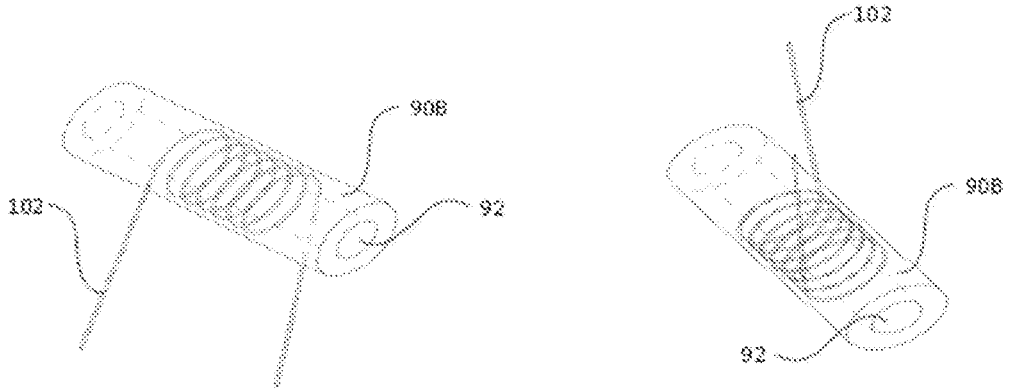
FIG. 5B shows two perspective views of a heating element with a hollow ceramic rod for e-liquid passage according to another embodiment of the present invention.

Referring now to FIGS. 5A and 5B, two perspective views of a heating element with a solid ceramic rod is shown in FIG. 5A and two perspective views of a hollow heating element for liquid solution passage are shown in FIG. 5B. In one embodiment, the heating element includes: (a) a solid heating rod 90A, and (b) a heating wire 102. In another embodiment, the heating element includes: (a) a hollow heating rod 90B having a through hole 92 in the center of the hollow heating rod, and (b) a heating wire 102. In one embodiment, the heating wire 102 is wound and embedded in the solid heating rod body 90A in a similar manner as in the embodiment shown in FIG. 4A. In another embodiment, the heating wire 102 is wound and embedded in the body of the hollow heating rod 90B in a similar manner as in the embodiment shown in 4B, between the outer surface and the through hole 92 of the hollow heating rod 90B.

Figure 6A:
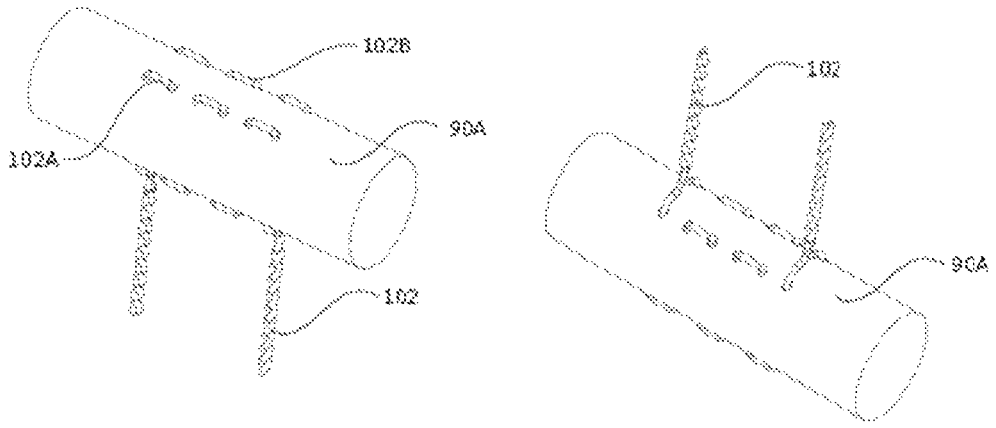
FIG. 6A shows two perspective views of a heating element with a solid ceramic rod according to one embodiment of the present invention.
Figure 6B:
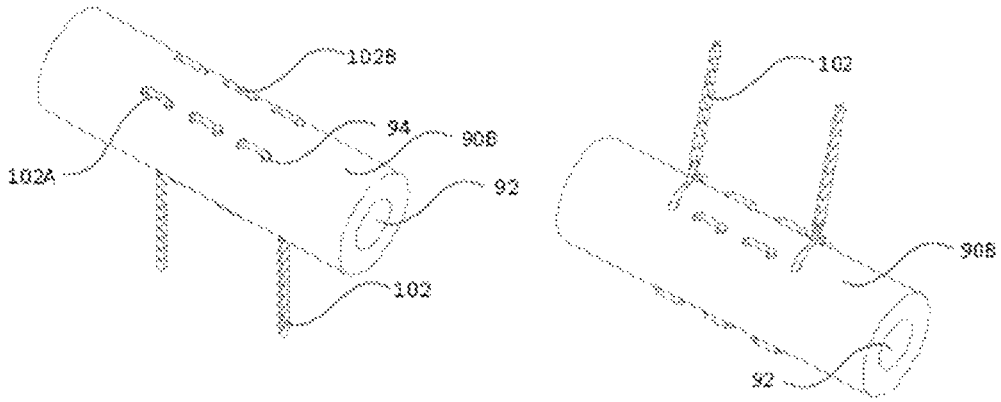
FIG. 6B shows two perspective views of a heating element with a hollow ceramic rod for e-liquid passage according to another embodiment of the present invention.

Referring now to FIGS. 6A and 6B, two perspective views of a heating element with a solid ceramic rod is shown in FIG. 6A and two perspective views of a hollow heating element for liquid solution passage are shown in FIG. 6B. In one embodiment, the heating element includes: (a) a solid heating rod 90A, (b) a first heating wire 102A and a second heating wire 102B, and (c) twelve through holes 94 in two rows with each row having six through holes 94 with substantially equal distance between these through holes 94. In another embodiment, the heating element includes: (a) a hollow heating rod 90B having a through hole 92 in the center of the hollow heating rod, (b) a first heating wire 102A and a second heating wire 102B, and, and (c) twelve through holes 94 in two rows with each row having six through holes 94 with substantially equal distance between these through holes 94. The heating wires 102A and 102B are wound in the following manner:

(a) thread the first end of the first heating wire 102A through the first through hole 94 of a first row;

(b) bend the second end of the first heating wire 102A towards the second through hole 94 of the first row;

(c) thread the second end of the first heating wire 102A through the second through hole 94 of the first row;

(d) bend the second end of the first heating wire 102A towards the third through hole 94 of the first row;

(e) thread the second end of the first heating wire 102A through the third through hole 94 of the first row;

(f) bend the second end of the first heating wire 102A towards the fourth through hole 94 of the first row;

(g) thread the second end of the first heating wire 102A through the fourth through hole 94 of the first row;

(h) bend the second end of the first heating wire 102A towards the fifth through hole 94 of the first row;

(i) thread the second end of the first heating wire 102A through the fifth through hole 94 of the first row;

(j) bend the second end of the first heating wire 102A towards the sixth through hole 94 of the first row;

(k) thread the second end of the first heating wire 102A through the sixth through hole 94 of the first row;

(l) repeat the operation (a) through (k) for the second heating wire 102B on the second row of the through holes;

(m) connect the first end of the first heating wire 102A to the first end of the second heating wire 102B; and (n) connect the second end of the first heating wire 102A to the second end of the second heating wire 102B.

These embodiments shown in FIGS. 6A and 6B are essentially the embodiments shown in FIGS. 3A and 3B, but the heating power of the embodiments shown in FIGS. 6A and 6B is doubled. The embodiments shown in FIGS. 3A, 3B, 4A, 4B, 5A, 5B, 6A and 6B can vary according to the specific requirements of the electronic cigarette designs. For example, in one embodiment, the heating rod 90A or 90B can have more than 6 holes. In another embodiment, the heating rod 90A or 90B can have less than 6 holes. In one embodiments, the heating rod 90A or 90B does not have through hole 94. In another embodiment, the heating rod 90A or 90B can have more than two rows of through holes 94. Each winding method can be repeated or reduced to accommodate the number of through holes 94 on the heating rod 90A or 90B.

The electronic cigarette having ceramic heating elements shown in above embodiments will have the following advantages:

(a) sustaining higher temperature;

(b) having no burning smell;

(c) prolonging the lifespan of the electronic cigarette;

(d) providing better air movement;

(e) providing better and reliable e-liquid movement;

(f) providing more consistent and even heating to the heating element;

(g) achieving better atomizing results; and (h) providing the electronic cigarette smoker a better experience.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims, the foregoing description and the exemplary embodiments described therein, and accompanying drawings.

The invention claimed is:

1. An electronic cigarette, comprising:

a hollow atomizing stem;

a first conductive ring sleeved at the bottom of the atomizing stem and airproof with the atomizing stem;

a second conductive ring arranged in the first conductive ring and insulated from the first conductive ring;

a conduit held in the atomizing stem, with the base of the conduit contacting the first conductive ring tightly;

a liquid blocker arranged on the top of the atomizing stem;

a cigarette mouthpiece arranged on the top of the atomizing stem simultaneously and holding the liquid blocker, wherein the inner wall of the atomizing stem, the outer wall of the conduit, the top of the first conductive ring, and the bottom of the liquid blocker together form a liquid storage chamber for storing e-liquid; and a solid heating rod with two end portions of the solid heating rod positioned in the liquid storage chamber, and a middle portion thereof passes transversally through the conduit and is held inside the conduit.

2. The electronic cigarette of claim 1, further comprises a battery positioned in a battery compartment at the bottom of the first conductive ring; and a mounting hole at the top of the first conductive ring, wherein the mounting hole is in communication with the battery compartment, the second conductive ring is arranged inside the mounting hole, and an insulation ring is arranged between the first conductive ring and the second conductive ring.

3. The electronic cigarette of claim 2, wherein the solid heating rod comprises one or more heating wires arranged on the body of the solid heating rod, wherein the one or more heating wires are configured to atomized the e-liquid surrounding the solid heating rod.

4. The electronic cigarette of claim 3, wherein the heating wires comprises:

nickel chromium alloy;

platinum wire; and iron chromium aluminum alloy wire with real earth element.

5. The electronic cigarette of claim 4, wherein the solid heating rod comprises a plurality of through holes in single line to wind one heating wire.

6. The electronic cigarette of claim 4, wherein the solid heating rod comprises a plurality of through holes in two lines to wind two heating wires.

7. The electronic cigarette of claim 6, wherein the two heating wires are electronically connected in parallel.

8. The electronic cigarette of claim 6, wherein the two heating wires are electronically connected in serial.

9. The electronic cigarette of claim 4, where in the two ends of the battery are electrically connected to the first conductive ring and the second conductive ring, respectively.

10. The electronic cigarette of claim 4, wherein the two ends of the heating wire are electrically connected to the first conductive ring and the second conductive ring, respectively.

11. An electronic cigarette, comprising:

a hollow atomizing stem;

a first conductive ring sleeved at the bottom of the atomizing stem and airproof with the atomizing stem;

a second conductive ring arranged in the first conductive ring and insulated from the first conductive ring;

a conduit held in the atomizing stem, with the base of the conduit contacting the first conductive ring tightly;

a liquid blocker arranged on the top of the atomizing stem;

a cigarette mouthpiece arranged on the top of the atomizing stem simultaneously and holding the liquid blocker, wherein the inner wall of the atomizing stem, the outer wall of the conduit, the top of the first conductive ring, and the bottom of the liquid blocker together form a liquid storage chamber for storing e-liquid; and a hollow heating rod with two end portions of the hollow heating rod positioned in the liquid storage chamber, and a middle portion thereof passes transversally through the conduit and is held inside the conduit.

12. The electronic cigarette of claim 11, further comprises:

a battery positioned in a battery compartment at the bottom of the first conductive ring; and a mounting hole at the top of the first conductive ring, wherein the mounting hole is in communication with the battery compartment, the second conductive ring is arranged inside the mounting hole, and an insulation ring is arranged between the first conductive ring and the second conductive ring.

13. The electronic cigarette of claim 12, wherein the hollow heating rod comprises one or more heating wires arranged on the body of the solid heating rod, wherein the one or more heating wires are configured to atomized the e-liquid surrounding the hollow heating rod.

14. The electronic cigarette of claim 13, wherein the heating wires comprises:

nickel chromium alloy;

platinum wire; and iron chromium aluminum alloy wire with real earth element.

15. The electronic cigarette of claim 14, wherein the hollow heating rod comprises a plurality of through holes in single line to wind one heating wire.

16. The electronic cigarette of claim 14, wherein the hollow heating rod comprises a plurality of through holes in two lines to wind two heating wires.

17. The electronic cigarette of claim 16, wherein the two heating wires are electronically connected in parallel.

18. The electronic cigarette of claim 16, wherein the two heating wires are electronically connected in serial.

19. The electronic cigarette of claim 14, where in the two ends of the battery are electrically connected to the first conductive ring and the second conductive ring, respectively.

20. The electronic cigarette of claim 14, wherein the two ends of the heating wire are electrically connected to the first conductive ring and the second conductive ring, respectively.

* * * * *